United States Patent [19]

Ehrenspeck

[11] 4,183,027

[45] Jan. 8, 1980

[54] DUAL FREQUENCY BAND DIRECTIONAL ANTENNA SYSTEM

[76] Inventor: Hermann W. Ehrenspeck, 94 Farnham St., Belmont, Mass. 02178

[21] Appl. No.: 935,048

[22] Filed: Aug. 18, 1978

Related U.S. Application Data

[63] Continuation of Ser. No. 840,469, Oct. 7, 1977, abandoned.

[51] Int. Cl.[2] ..... H01Q 3/00

[52] U.S. Cl. ..... 343/726; 343/789

[58] Field of Search ..... 343/726, 725, 727, 728, 343/789, 837, 834–836, 817, 819

[56] References Cited

U.S. PATENT DOCUMENTS

| | | | |
|---|---|---|---|
| 3,438,043 | 4/1969 | Ehrenspeck | 343/837 |
| 3,508,278 | 1/1970 | Ehrenspeck | 343/837 |
| 3,605,104 | 9/1971 | Weston et al. | 343/837 |
| 3,742,513 | 6/1973 | Ehrenspeck | 343/837 |

FOREIGN PATENT DOCUMENTS

| | | | |
|---|---|---|---|
| 650592 | 4/1948 | United Kingdom | 343/789 |

OTHER PUBLICATIONS

Termon's Electronic and Radio Engineering, 4th Edition, McGraw Hill, 1955, pp. 907 and 908.

*Primary Examiner*—David K. Moore
*Attorney, Agent, or Firm*—Joseph E. Rusz; George Fine

[57] ABSTRACT

A dual frequency band directional antenna or system in the form of a cavity reflector antenna mechanically combined and radiation-coupled with a loop of approximately the same shape and periphery as the rim edge of the cavity reflector, which loop is arranged outside and in front of, and in close proximity and parallel to the cavity rim edge, and, when properly energized, acts for the lower frequency band as a loop radiator with preselected field polarization, whereby the entire cavity structure serves two purposes by acting simultaneously as reflector for the higher frequency band cavity reflector antenna and for the lower frequency band, electrically separate loop radiator, with the radiation patterns of both sources being unidirectional over both frequency bands and with their radiation maxima directed into the center axis normal to the bottom plate of the cavity reflector structure.

17 Claims, 9 Drawing Figures

FIG. 1
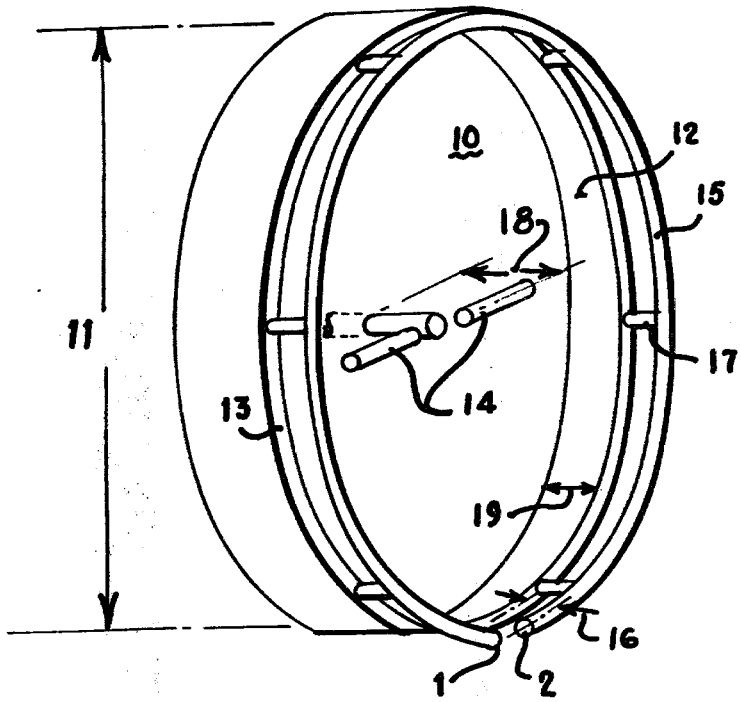
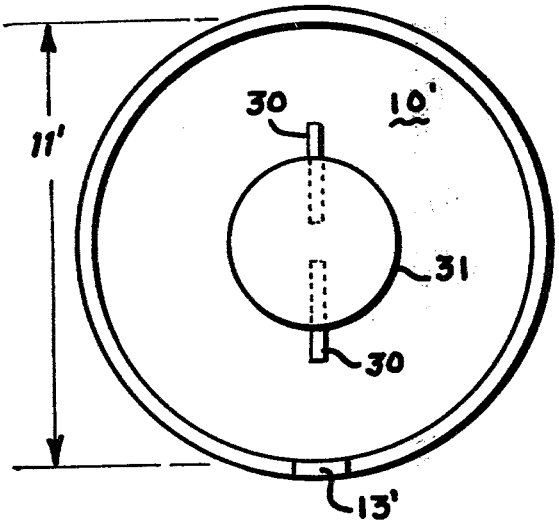
FIG. 3a
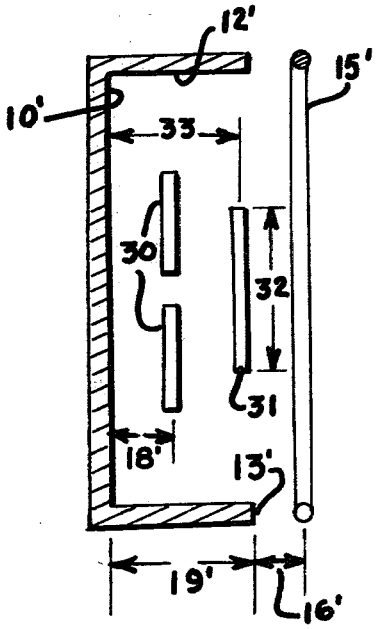
FIG. 3b

DUAL FREQUENCY BAND DIRECTIONAL ANTENNA SYSTEM

STATEMENT OF GOVERNMENT INTEREST

The invention described herein may be manufactured and used by or for the Government for governmental purposes without the payment of any royalty thereon.

This is a continuation, of application Ser. No. 840,469, filed Oct. 7, 1977 and now abandoned.

BACKGROUND OF THE INVENTION

This invention refers to a dual frequency band directional antenna or system which constitutes a combination of two antenna types of predetermined dimensions. One of them is a gain-optimized cavity reflector antenna for the higher frequency band and the other is a loop radiator of approximately the same shape and periphery as the cavity rim edge for the lower frequency band. Although both radiating sources are separately energized, they use the entire cavity structure as their common reflector and together form a combination antenna, whose radiation maxima are directed into the center axis normal to the backwall of the cavity structure over both of their frequency bands.

The optimized cavity reflector antenna with its typical radiation characteristics is discussed in literature, for example, in the paper "A New Class of Medium-Size High-Efficiency Reflector Antennas," by Hermann W. Ehrenspeck, published in IEEE Transactions on Antennas and Propagation, Vol. AP-22, No. 2, March 1974, pp 329–332. The paper teaches that a circular cavity reflector antenna, consisting of a pan-like cavity reflector and a feed, for example, a dipole in the center of the cavity, reaches several distinct gain maxima when its frequency of operation is changed. More specifically, directive gain maxima are obtained, when, the diameter of the reflector is near to 1.35 or 2.35 times $\lambda_H$, or its periphery near to 4.25 or 7.35 times $\lambda_H$ which is the wavelength of the highest operating frequency; and when the surrounding rim is optimized in its width. A typical example is a circularly shaped cavity reflector antenna as shown in FIG. 1 of the reference publication. The cavity is formed by the planar reflector surface A of diameter $D_A$ and the rim B of width $W_B$ which surrounds the reflector area. The edge of the rim is marked as E. Feed F, shown as a dipole, is located in the normal axis of the cavity at a distance $d_F$ from and parallel to the reflector surface A. The linear dipole feed provides linear polarization. Crossed dipoles or any other radiator that provides the desired polarization response may also be used. Of special interest for the present invention is a cavity reflector antenna with a diameter of near to $1.35\lambda_H$. For highest directive gain the antenna's surrounding rim has to be adjusted to approximately $0.4\lambda_H$ for narrow-band and to approximately $0.3\lambda_H$ for wide-band optimum gain performance over a frequency bandwidth of approximately 2:1. In the latter case the gain maximum is somewhat lower and the gain-versus-frequency curve is approximately proportional to the reflector area in square-wavelength, i.e., the radiation efficiency of the cavity reflector antenna stays approximately constant over the entire 2:1 frequency band.

The loop antenna, which is used as the second radiating source of the combination antenna according to this invention, also has its typical radiation characteristics described in literature. For diameters smaller than one wavelength the loops are usually considered as magnetic dipoles which have radiation minima in the axis normal to the plane of the loop and maxima in the plane of the loop. Loop antennas with such dimensions are often used for direction finding. They could, however, not be applied to the combination antenna according to this invention, as their radiation maximum does not appear in the required direction normal to the plane of the loop. Fortunately this requirement is met by a loop antenna whose perimeter length is one wavelength $\lambda_L$ of its optimum-gain frequency $f_L$. If a circular antenna shape is selected, the loop diameter has to be chosen as $\lambda_L/\pi$. Loop antennas of this type, either of circular, or square shape can be found in combination with a second loop of a little larger perimeter which serves as a reflector. This arrangement has wide application as transmitting and receiving antennas for radio amateur stations because of its markedly increased gain in the forward direction. It should be mentioned, however, that the one-wavelength resonance of the loop radiator limits its operable frequency bandwidth because the wavelength-related changes in the loop current distribution prevent the occurrence of the radiation maximum in the axis normal to the plane of the loop.

The loop is usually made from wire or tubing or can be a narrow metal strip. The location of the feed points on the loop determines its polarization response. If the loop is energized with out-of-phase currents at preselected feed points, the resulting loop current distribution initiates a horizontally polarized field radiation. The radiation pattern is similar to that of two vertically stacked horizontal dipoles and a marked directive gain increase is noticed in the H plane of the loop radiator. Radiation maxima appear in the normal axis on both sides of the loop, while minima appear in the plane of the loop at angles 90° off its normal axis. If the loop radiator is energized at different preselected feed points, the radiation maxima can still be directed into the normal axis of the loop; but they are now vertically, instead of horizontally, polarized. Switching from the first to the second preselected points permits linear cross polarization. To obtain circular polarization a 90° phase shift has to be introduced at one of the feed points.

According to another method, the loop can be energized by a coaxial cable, whose conductor is connected to a first or second preselected feed point with the cable shield connected to the cavity reflector structure for horizontal or vertical polarization response of the radiation field.

In the combination of the two antenna types the loop is supported by nonconducting spacers at a distance of approximately one-tenth to one-twentieth of the cavity diameter from the edge of the cavity rim. The combined radiating sources form one unit, which, for optimized parametrs radiates or receives two discrete frequency bands with their center frequencies more than one octave apart from each other.

SUMMARY OF THE INVENTION

In accordance with the present invention there is provided a dual frequency band, directional antenna system, which is obtained by electrically and mechanically combining two separately energized radiators of the same cross-sectional area in such a way that the second radiator uses the entire metal structure of the first as its own reflector for directing its radiated energy with a unidirectional pattern into the same maximum direction as that of the first antenna type. Thus the radiation maxima of both radiators are appearing in the axis normal to the backwall of the cavity reflector of the first radiator. One of them is a gain-optimized high-efficiency cavity reflector antenna as described for circular-shaped cavity structures in FIGS. 1 and 3 U.S. Pat. No. 3,742,513; the other is a loop radiator having the same diameter as the cavity reflector antenna. The loop radiator is arranged in front of the cavity rim edge. More specifically, the cavity reflector antenna is optimized for the higher frequency band and the loop radiator for the lower of the two discrete frequency bands. However, the ratio of the optimally performing frequency bands cannot be randomly chosen; they are rather tightly linked together. If one of them is chosen, the other frequency band as well as all physical dimensions of the combination antenna are determined.

Since both sources are tightly coupled, because of their close proximity, a strong interaction between their radiation patterns would be expected; however, it has been contrarily found that the presence of the loop in front of the cavity has only little or practically no effect on the performance of the cavity reflector antenna.

For the circular-shaped, optimized, cavity reflector antenna presented in FIG. 1 of U.S. Pat. No. 3,742,513, for example, the cavity diameter is $D_A \cong 1.35\lambda_H$ and, therefore, the wavelength of the highest operating frequency $\lambda_H \cong D_A/1.35$. When the loop radiator of the same diameter $D_A$ is positioned in front of the cavity structure, the wavelength of the center frequency of the lower frequency band is determined as $\lambda_L \cong \pi \cdot D_A$. Hence the ratio of $\lambda_H/\lambda_L \cong 0.237$ and the ratio of the two optimized frequency bands $\cong 4.25$.

This ratio may be slightly modified choosing a loop of a little smaller or larger periphery than that of the cavity reflector rim. It should be mentioned, however, that by a loop extension outside the cavity rim edge increases somewhat the backlobes of the radiation patterns in the low-frequency band, and a loop location inside the cavity rim would somewhat decrease the radiating aperture and gain in the high-frequency band. For best results in respect to the structural simplicity of the combination antenna and for optimal radiation patterns in both frequency bands the periphery of loop and rim edge should be made the same.

The arrangement of the loop radiator in front of and at a narrow spacing from the same perimeter cavity rim edge, instead of locating it side by side with the cavity reflector antenna, results in some structural advantages for the combination antenna. First, the optimized loop radiator does not need a separate loop reflector; second, the axial antenna length of the antenna combination is only very little increased and its cross-sectional area and wind resistance is not enlarged. This antenna is well fitted for use in airplanes and space vehicles. The cavity reflector can be flush-mounted into the metallic surface with the loop radiator as the only protruding portion of the combination antenna. As the loop is positioned in close proximtiy of the cavity rim edge, the entire antenna structure can be covered by a low-profile radome. The space needed for containing the dual frequency band antenna system is only very little changed by attaching the second radiator for the low-frequency band coverage.

A typical combination antenna model, according to the invention, showed directive gains from 9 to 13 dB in its high-frequency band, and of approximately 7.5 dB for the center of its low-frequency band. It develops a 2 to 4 dB higher directive gain than conventional reflector antennas of approximately the same dimensions. Since the antenna structure is a very small and compact radiator, it can be used as a television receiving antenna. More specifically it can, because of the frequency ratio of approximately 4.25 of its two optimized frequency bands, receive with favorable pattern characteristics the frequency bands of approximately 450 to 900 MHz and 170 to 230 MHz, i.e., those frequency bands which are by international regulations allocated for UHF and VHF television use.

DESCRIPTION OF THE DRAWINGS

FIG. 1 shows, pictorially and somewhat schematically one preferred embodiment of the combination antenna of this invention;

FIGS. 3*a* and 3*b* schematically show a combination of a short-backfire and a loop antenna in a front and side view in cross section, respectively;

DETAILED DESCRIPTION OF THE PREFERRED EMBODIMENTS

Figure 2A:
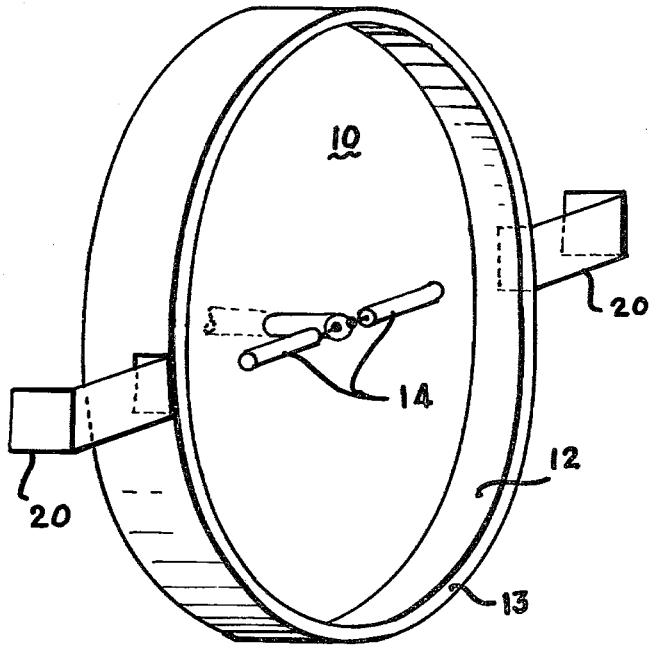
FIGS. 2*a* and 2*b* illustrate two examples of the cavity structure only of the combination antenna with metal strips for low backlobe adjustment.

In the structure of the antenna combination described in this invention the loop radiator is supported by non-conducting spacers in front of the cavity reflector antenna in a position parallel to the rim edge. A typical combination antenna according to the invention is presented in FIG. 1. It consists of the circular planar reflector 10 of diameter 11, the rim 12 of width 19 with edge 13, and the feed 14. Feed 14 is shown as a dipole located symmetrically about the normal axis of the cavity at a distance 18 from its center line to the reflector surface 10 and parallel thereto. The dipoles are conventionally mounted and connected as illustrated in FIG. 2. The loop radiator is designated as 15. It is held in its typical position such that its center line is at a distance 16 from the rim edge 13 and parallel thereto by spacers 17, and is energized at the terminals 1 and 2. The entire cavity structure acts as a reflector for the loop and thus enhances the radiation into the forward direction of the combination antenna from planar reflector 10 toward loop 15, and descreases it in the backward direction. It has been found that the presence of the loop in front of the cavity reflector antenna has very little influence on the radiation patterns in the high-frequency range of the combination antenna.

In order to obtain the lowest back lobes in the lower frequency band a phase difference as near as possible to 180° should be adjusted for between the farfield radiation of the loop radiator and that of the cavity reflector structure. It has been found that the back lobe suppression is mainly a function of the loop spacing 16. Since for a larger loop spacing the axial length of the combination antenna is increased and, therefore, the great advantage of the compactness of the combination antenna is gradually lost, a compromise has to be made between antenna length and front-to-backward ratio in the radiation patterns.

It has been found that back lobe reduction can also be obtained by attaching to the cavity rim metal strips or wires, which perform as reflector extensions in the direction of polarization. They can be attached to the rim edge or to the back wall of the cavity reflector by any conventional means. By varying their length beyond the rim the back lobes can be suppressed to levels more than 20 dB below the radiation maximum of the combination antenna in its forward direction. The antenna can be "tuned" for its lowest back lobe level over the entire low-frequency range. At optimal adjustment most of the backward radiation is directed into the forward direction and the antenna gain is markedly increased. Pattern measurements have shown that the length adjustment of the metal strips or wires has only neglibile influence on the high-frequency band performance of the combination antenna.

Figure 2B:
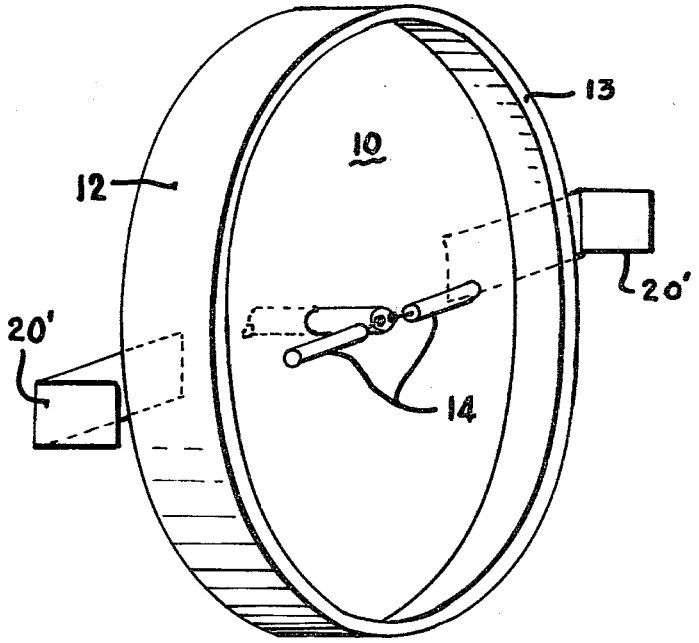

The low back lobe adjustment of the metal strips increases the antenna dimensions in the plane of polarization. They can, however, be kept much shorter if they are bent into the shape of an L. This shape increases the electrically effective length of the metal strips and decreases their extension outside the cavity structure in the same manner as it shortens the physical length of resonant dipoles. FIGS. 2*a* and 2*b* present two examples of cavity structures of the combination antenna, which are provided with metal strips 20 or 20' for low back lobe adjustment. With their bent portions extending parallel to the cavity walls they are attached to the rim edge in FIG. 2*a* and to the back wall of the cavity in FIG. 2*b*. For simplicity reasons the loop is omitted in both sketches.

In the antenna according to FIG. 2*b*, the metal strips can be made adjustable in length. They can be slid along or into into the back wall of the cavity structure when the antenna is shipped and extended to their optimum length to reduce back lobes. For example, in TV applications which require the minimization of the reception of backward radiation and ghost-forming reflection. As earlier indicated, wires shaped according to the extended strip perimeters may be utilized.

A combination antenna model according to FIG. 2*b* plus a loop as taught in FIG. 1, which was gain-optimized for 860 MHz, covered a frequency range of 2:1 at its high-frequency band, and of approximately 200 MHz±15% at its low-frequency band. The ratio of signal reception from the front and backward directions was higher than 20 dB over most of the high-frequency range, and an equally favorable front-to-back ratio could be reached in the low frequency range by extending the metal strips or wire structures to their optimum length.

Although the aforementioned typical cavity reflector antenna has a diameter 11 of $1.35\lambda_H$ one with a diameter of $2.35\lambda_H$, an antenna can be combined with a loop antenna, as shown in FIGS. 3*a* and 3*b*. The two antenna types differ only in their physical dimensions and in their feed systems which in the aforementioned typical cavity reflector antenna is a dipole and in FIGS. 3*a* and 3*b*, a short-backfire element consisting of dipole 30 and secondary, partial reflector disk 31. Thus, the greater energy spread of the backfire elements enables the illumination of the aperture of the larger dimensioned antenna. In FIGS. 3*a* and 3*b*, which present, respectively, a schematic front view of the combination antenna and a cross-sectional side view, the same numerals represent similar elements and dimensions as in the aforementioned typical reflector antenna except that a prime is applied. In addition, the secondary reflector disk of diameter 32 is designated by numeral 31 and its distance from the cavity back wall as 33. In FIG. 3*b* the position of the loop radiator 15 is also shown.

The cavity diameter $D_A$ marked 11' in FIG. 3 is $D_A \cong 2.35\lambda_H$ and, therefore, the wavelength of the highest operating frequency $\lambda_H \cong D_A/2.35$. When the loop radiator 15' of diameter 11' is attached, the wavelength of the center frequency of the lower frequency band is $\lambda_L \cong \pi D_A$. Hence the ratio of $\lambda_H/\lambda_L \cong 0.136$ and the ratio of the two optimized frequency bands approximately equals 7.35.

The antennas of the Figures thus far described utilize circular cavity reflectors and circular loops. Approximately the same gain and pattern characteristics are obtained by the use of a square or polygonally shaped cavity reflectors with symmetry about the normal axis and the same periphery, i.e., with a perimeter of near to a wavelength.

Additionally, some recectangularly, elliptically, or ovally shaped cavity reflectors can be utilized. However, limitations with these shapes are dictated by the changes in their E- and H-plane patterns and dimensional constraints over those of circular or square reflector shapes. Changes in shape of the cavity reflector combination antenna produce greater E- and H-plane pattern changes with the embodiment of FIGS. 3*a* and 3*b*. Therefore, a limited adjustment of the E-plane and H-plane patterns may be performed by the selection of the cavity reflector shape and the orientation of its axis of rotation.

Figure 4:
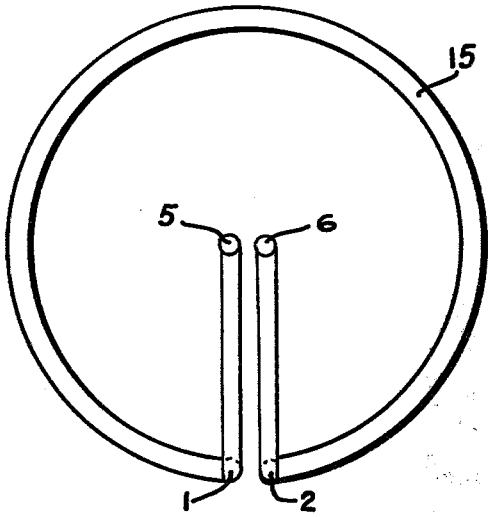
FIG. 4 illustrates another feed for the loop radiator of any of the combination antennas.
Figure 5:
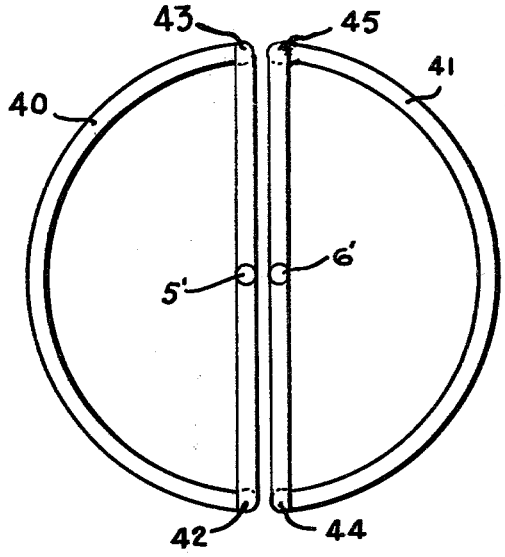
FIG. 5 shows still another feed for the loop radiator.
Figure 6A:
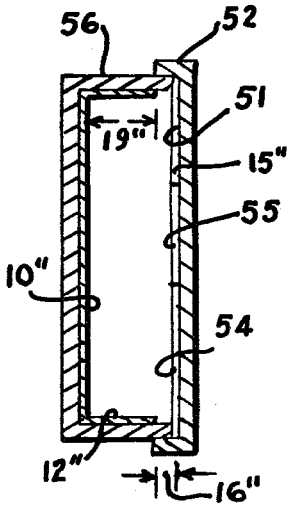
FIGS. 6*a* and 6*b* illustrate a weatherproof version of the combination antenna with FIG. 6*a* showing a cross-sectional view of FIGS. 6*b* a view looking into the cover.
Figure 6B:
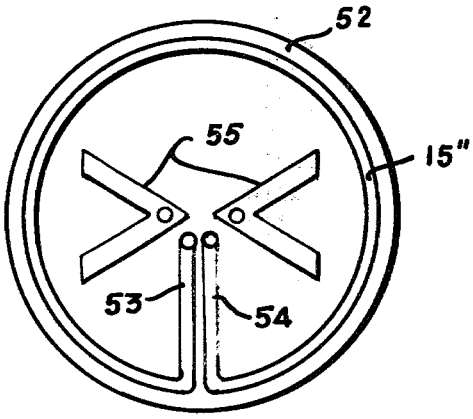

In our experiments a broadband bow tie, located in the center, was used as feed for the higher-frequency band of the combination antenna. The loop was energized at the terminals 1 and 2, as shown in FIG. 1. It could also be fed from the cavity center, if the terminals 1 and 2 were connected by parallel wire conductors with the two feedpoints 5 and 6 in or near to the cavity reflector center, as shown in FIG. 4. By adjusting the spacing and dimensions of the wires, matching between the loop and the feedline can be changed. Still another method of energizing the loop is presented in FIG. 5. The loop is cut into two equal sections 40 and 41, whose open ends, 42, 43 and 44, 45 are connected by two parallel wires with the feed terminals 5' and 6' in the center of the wire lengths. This structure is completely symmetric in respect to the feed points and therefore offers the best symmetry in the E- and H-plane patterns of the loop radiator. The feed arrangements of FIGS. 4 and 5 can also be utilized with the short backfire, cavity, combination antenna.

The cavity reflector can be made from metal sheet material or metallic mesh with sufficiently narrow wire spacing, or can in its simplest form be manufactured as a pan-like circular box of dielectric material, whose interior area is metallized to serve as the cavity reflector of the combination antenna. If the cavity walls are extended beyond the metallized portions of the rim edge by the width 16 (see FIG. 1) or 16' (see FIG. 3*b*), the loop can be metallized on the edge of the extended sidewall. The combination antenna can be easily made weatherproof by closing the entire structure with a dielectric plate, which is surrounded by a flange of such diameter that it slips over or into the sidewall of the cavity reflector box. The dielectric cover plate may be used at the same time as support for the loop radiator with its parallel-wire feedline and the broadband feed of the cavity reflector antenna.

A typical example of a weatherproof version of the combination antenna according to the invention is sketched in FIGS. *6a* and *6b* with FIG. *6a* showing a cross-sectional, and FIG. *6b* a view looking into the cover. The metallic reflector and rim of the dielectric cavity reflector portion 56 are designated by numerals 10″ and 12″, respectively, and have the distance between the rim and loop dimensioned 16″ with a rim width shown as 19″. The bottom or inside of the cover plate is designated as 51 and its circumferential flange as 52. The loop radiator 15 and its parallel-wire feedline 53, 54 are metallized on the inside of cover plate 51. The cavity reflector feed, which is shown in the form of a modified bow-tie 55, is also metallized on the inside of 51.

The application of printed circuit techniques can simplify the production of the cover plate with the conductors. Also, matching devices for the two antenna feeds and means for connecting the energizing cable with the antenna terminals can be included. FIG. *6a* presents the entire combination antenna, which consists of only two structural components, the partially metallized cavity reflector 56 to form the reflectors 10″ and rim 12″ and the press fitted dielectric cover plate 51, with flange 52, which contains all electrical components.

What is claimed is:

1. A dual frequency band directional antenna system comprising a cavity reflector antenna having a cavity, said cavity reflector antenna having predetermined outer dimensions, first feed means for said cavity reflector antenna, a loop forming an antenna having approximately the same outer dimensions as the cavity reflector antenna and being arranged outside and in front of said cavity reflector antenna at a predetermined distance therefrom, said cavity acting simultaneously as a reflector for said cavity reflector antenna and said loop, and second feed means for said loop such that said dual frequency antenna system is capable of receiving and transmitting two distinct frequency ranges.

2. A dual frequency antenna system as described in claim 1 wherein said cavity includes a reflector of a predetermined diameter and a rim of predetermined width attached electrically to said reflector, said rim having an edge, and nonconducting spacers maintaining said loop at said predetermined distance from said cavity reflector antenna.

3. A dual frequency directional antenna system as described in claim 1 wherein said cavity reflector antenna is comprised of a planar reflector of predetermined diameter and a rim of predetermined width attached electrically to said planar reflector, said rim having an edge, and nonconducting spacers positioning said loop in front of said edge and parallel thereto.

4. A dual frequency band directional antenna system as described in claim 1 wherein said cavity is comprised of a planar reflector of a predetermined diameter and a rim electrically attached to said planar reflector, said planar reflector and said rim operating in combination as said cavity.

5. A dual frequency band directional antenna system as described in claim 2 including metal strips or wire structures of adjustable lengths attached to said rim to operate as reflector extensions for backlobe reduction.

6. A dual frequency band directional antenna system as described in claim 2 wherein said reflector includes a backwall, and metal strips or wire structures of adjustable lengths attached to said backwall to obtain backlobe reduction.

7. A dual frequency band directional antenna system as described in claim 1 wherein said outer dimensions are circular.

8. A dual frequency band directional antenna system as described in claim 1 wherein said outer dimensions are rectangular.

9. A dual frequency band directional system as described in claim 1 further including dielectric plate means press fitted to the combination of said cavity reflector antenna and said loop for weather protection thereof.

10. A dual frequency band directional antenna system as described in claim 1 including a cavity reflector, a dielectric cover plate press fitted to said cavity reflector to form a weatherproof interior, said dielectric cover plate having a circumferential rim, said loop being metallized on the inside of said cover plate, and a cavity reflector first feed means being in the form of a bow tie also metallized on the inside of said dielectric cover plate, said second feed means for said loop also being metallized on the inside of said dielectric cover plate.

11. A dual frequency band, directional antenna comprising a cavity reflector antenna comprising
- a reflector
- a rim connected with said reflector to form a cavity and
- a feed means for said cavity reflector antenna; and a loop radiator having a separate feed means, said radiator being spaced from the rim of said cavity reflector antenna and of substantially the same perimeter such that said cavity acts, simultaneously, as a reflector for said cavity reflector antenna and said loop radiator for transmission or reception at two distinct frequency ranges.

12. A dual frequency band directional antenna as defined in claim 11 wherein said cavity reflector antenna is of the backfire type having a partial reflector with said feed means for said cavity reflector antenna located between said reflector with said rim and said partial reflector.

13. A dual frequency band directional antenna as defined in claim 11 including means electrically connected with said cavity and located externally thereof with an effective length which increases the cavity reflectivity in the direction of polarization for backlobe reduction.

14. A dual frequency band directional antenna as defined in claim 11 wherein said loop radiator is center fed by a parallel wire line.

15. A dual frequency band directional antenna as defined in claim 11 wherein said reflector and rim of said cavity reflector antenna are of conductive material on a dielectric material shaped in the form of said cavity, said dielectric material forming an extension beyond said rim to space said loop radiator from said rim.

16. A dual frequency band directional antenna as defined in claim 15 including a dielectric cover to weatherproof said combination antenna by engaging with and closing the dielectric material forming said cavity reflector antenna and extension, said dielectric cover having said loop radiator and said feed means for said cavity reflector antenna metallized on the side of said cover facing said reflector of said cavity reflector antenna.

17. A dual frequency band directional antenna as defined in claim 11 wherein the perimeters of said cavity reflector antenna and said loop radiator are substantially coextensive.

* * * * *